US006912180B2

(12) United States Patent
Dias

(10) Patent No.: US 6,912,180 B2
(45) Date of Patent: Jun. 28, 2005

(54) TIMEPIECE WITH CALENDAR

(75) Inventor: Carlos Dias, Carouge (CH)

(73) Assignee: Manufacture Roger Dubuis S.A., Geneva (CH)

( * ) Notice: Subject to any disclaimer, the term of this patent is extended or adjusted under 35 U.S.C. 154(b) by 0 days.

(21) Appl. No.: 10/918,259

(22) Filed: Aug. 13, 2004

(65) Prior Publication Data

US 2005/0018542 A1 Jan. 27, 2005

Related U.S. Application Data

(63) Continuation of application No. PCT/CH03/00164, filed on Mar. 12, 2003.

(30) Foreign Application Priority Data

Mar. 28, 2002 (EP) ..... 02405246

(51) Int. Cl.[7] ..... G04B 19/24
(52) U.S. Cl. ..... 368/37; 368/34; 368/28
(58) Field of Search ..... 368/16–28, 31–38, 368/124, 125, 127, 139, 169–172

(56) References Cited

U.S. PATENT DOCUMENTS 1,336,150 A * 4/1920 Niemczura ..... 368/39
3,673,789 A * 7/1972 Tsuzuki et al. ..... 368/37
3,750,385 A * 8/1973 Kocher ..... 368/35
4,422,775 A * 12/1983 Thoenig ..... 368/74
4,674,889 A * 6/1987 Klaus ..... 368/28
5,184,333 A * 2/1993 Caspar ..... 368/28
5,432,759 A * 7/1995 Vaucher ..... 368/28
5,699,321 A * 12/1997 Vaucher ..... 368/37
5,903,519 A * 5/1999 Takahashi et al. ..... 368/35
5,943,299 A * 8/1999 Genta ..... 368/28
6,118,734 A * 9/2000 Ray et al. ..... 368/37
6,543,681 B1 * 4/2003 Wiederrecht et al. ..... 235/60 C
6,582,118 B1 * 6/2003 Nakajima et al. ..... 368/184
6,584,040 B1 * 6/2003 Nakajima et al. ..... 368/28
6,687,191 B2 * 2/2004 Watanabe et al. ..... 368/37
6,744,696 B2 * 6/2004 Vernay et al. ..... 368/37
6,826,122 B2 * 11/2004 Zaugg ..... 368/28
2003/0198139 A1 * 10/2003 Kitahara et al. ..... 368/28
2004/0190381 A1 * 9/2004 Tokoro et al. ..... 368/110

* cited by examiner

*Primary Examiner*—Kamand Cuneo
*Assistant Examiner*—Jeanne-Marguerite Goodwin
(74) *Attorney, Agent, or Firm*—Sturm & Fix LLP

(57) ABSTRACT

The invention relates to a timepiece comprising a time train, a 31-toothed wheel, a wheel of units of 30 teeth plus a space corresponding to a tooth which is used to drive a star-wheel of units and a four-toothed wheel for driving a star-wheel of tens, a year cam which is solidly connected to a wheel, and drive means for driving said 31-toothed wheel by one revolution per month and the year cam by one revolution per year. The aforementioned 31-toothed wheel is solidly connected to a corrector element. The drive means comprise a cam which is solidly connected to a wheel, a driving yoke, elastic means which are used to press said yoke against the cam, a corrector yoke, a feeler which is arranged to detect the position of the year cam and elastic means in order to connect said yokes to one another.

10 Claims, 5 Drawing Sheets

SECTION V-V

---------- = SECTION V-V

SECTION V-V

TIMEPIECE WITH CALENDAR

CROSS REFERENCE TO RELATED APPLICATIONS

This application is a Continuation of PCT/CH03/00164 filed Mar. 12, 2003, claiming priority of European Application No. 02405246.6 filed Mar. 28, 2002, which is included in its entirety by reference made hereto.

BACKGROUND OF THE INVENTION

1. Field of the Invention

The present invention relates to a timepiece with a large-format calendar display and instantaneous jump comprising a time train, a day-of-the-month runner comprising a 31-toothed wheel, a unit wheel of 30 teeth plus one space corresponding to a tooth for driving a 10-toothed unit pinion and a 4-toothed wheel for driving a 4-toothed tens star, an annual cam secured to a 12-toothed wheel, and drive means connected to said time train for driving said day-of-the-month runner by one revolution per month and the annual cam by one revolution per year.

2. Description of Related Art

Numerous watches exist that have various indications derived from time, such as the date(the day, the day of the month and the month), the phases of the moon, and indication of several time zones in particular. The proliferation of these indications usually makes them difficult to read. This difficulty of reading may be the result as much as of the layout as of the magnitude of the indications. In many cases, the change of indication is not instantaneous but trailing, especially in the case of an annual or even perpetual calendar. The days of the month are often displayed by a needle moving past a day-of-the-month dial rather than using numerals appearing in a window formed in the dial, making them less easy to read. Furthermore, displaying the day of the month using a disk bearing the days of the month from 1 to 31 limits the possible magnitude of these numerals, which means that proposals have already been made for the tens and the units to be displayed on two separate disks so that their size can be increased, thus making the mechanism more complicated.

It is obvious that the more indications there are, and the smaller the timepiece, particularly in the case of a wristwatch, rather than a pocket watch, the more difficult these problems are to solve. Even though numerous solutions exist, it is, however found, that none of them meet all the increasingly broad requirements in terms of complex horology aimed first and foremost at demanding collectors who insist that the boundaries of the possible be pushed back further and further. It is necessary not only to be able to meet new technical challenges, but also for the dimensions of such mechanisms to remain acceptable for a watch that has to be worn on the arm, both in terms of the area and in terms of the thickness and to do so without detracting from the reliability which remains the essential criterion.

BRIEF SUMMARY OF THE INVENTION

The object of the present invention is specifically to contrive for the calendar mechanism of the timepiece to allow large-format display in a calendar with instantaneous jump.

To this end, the subject of the present invention is a timepiece with a large-format display calendar and instantaneous jump as defined by claim 1.

Advantageously, the calendar of this timepiece is a perpetual calendar and includes a display of the days and of the months.

As a preference, this calendar also includes an indication of the phases of the moon, which is coaxial with an additional train for indicating a second time zone, driven by the main indicator train situated at the center of the watch.

The design of this timepiece with calendar is intended to offer a clear display that is easy to read both in terms of the layout of the information displayed and in terms of legibility, by virtue of its having sufficiently large characters. All the information displayed changes instantaneously and preferably requires no correction, the corrections being made by the annual cam.

Other particulars and advantages of the present invention will become apparent in the course of the description which will follow and which will make reference to the attached drawings which, schematically and by way of example, illustrate one embodiment of the timepiece with calendar that is the subject of the present invention.

BRIEF DESCRIPTION OF THE SEVERAL VIEWS OF THE DRAWINGS

FIGS. 1 and 2 essentially show the calendar mechanism of the timepiece according to the present invention, which comprises a drive wheel 1 secured to the hour wheel RC, illustrated in section in FIG. 5, engaging with a wheel 2 and which makes one revolution in 12 hours. The ratio between this pinion 2 and the drive wheel 1 is 2:1 which means that the wheel 2 makes one revolution per day.

DETAILED DESCRIPTION OF THE INVENTION

Figure 1:
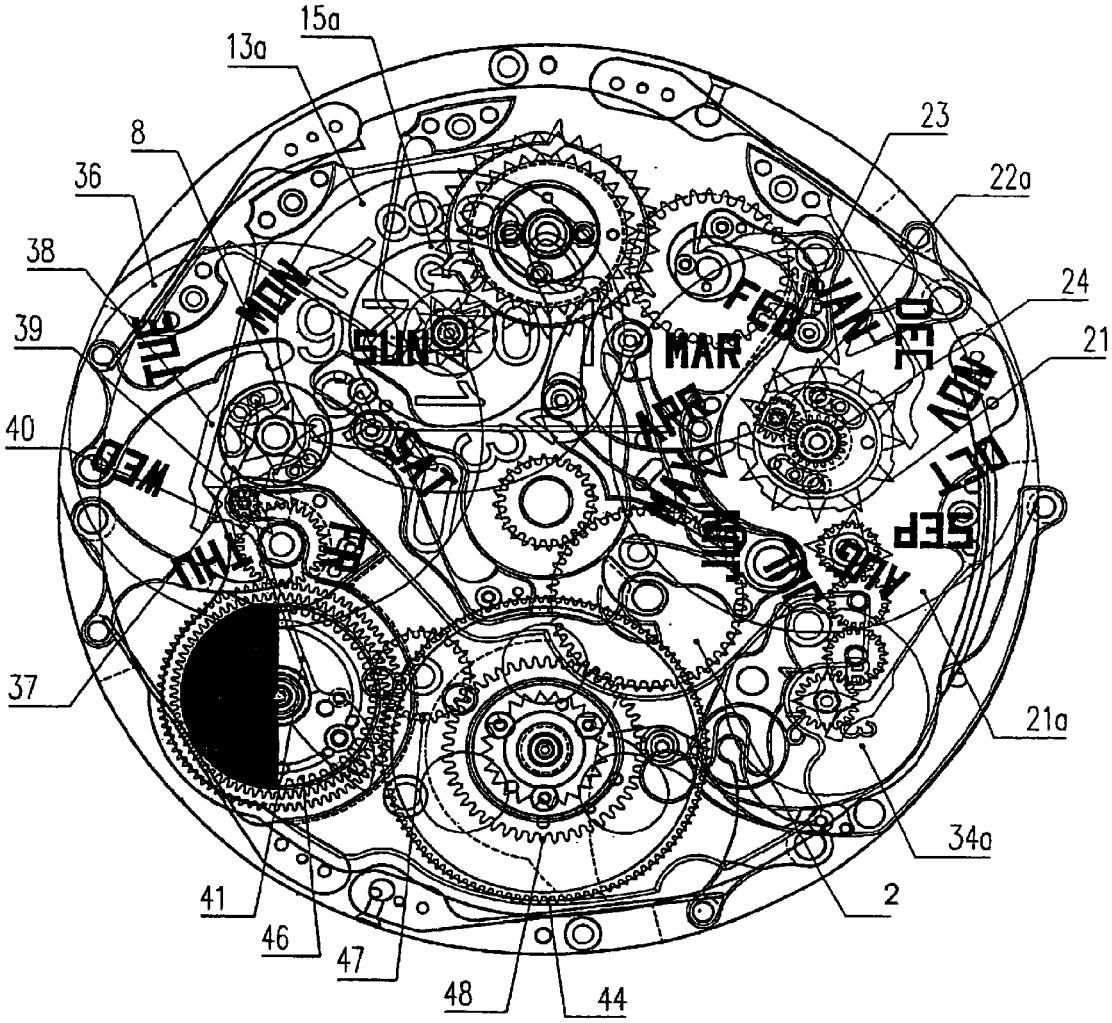
FIG. 1 is a plan view of this embodiment, in which the various indicator disks have been shown as transparent in order to reveal the mechanism.
Figure 2:
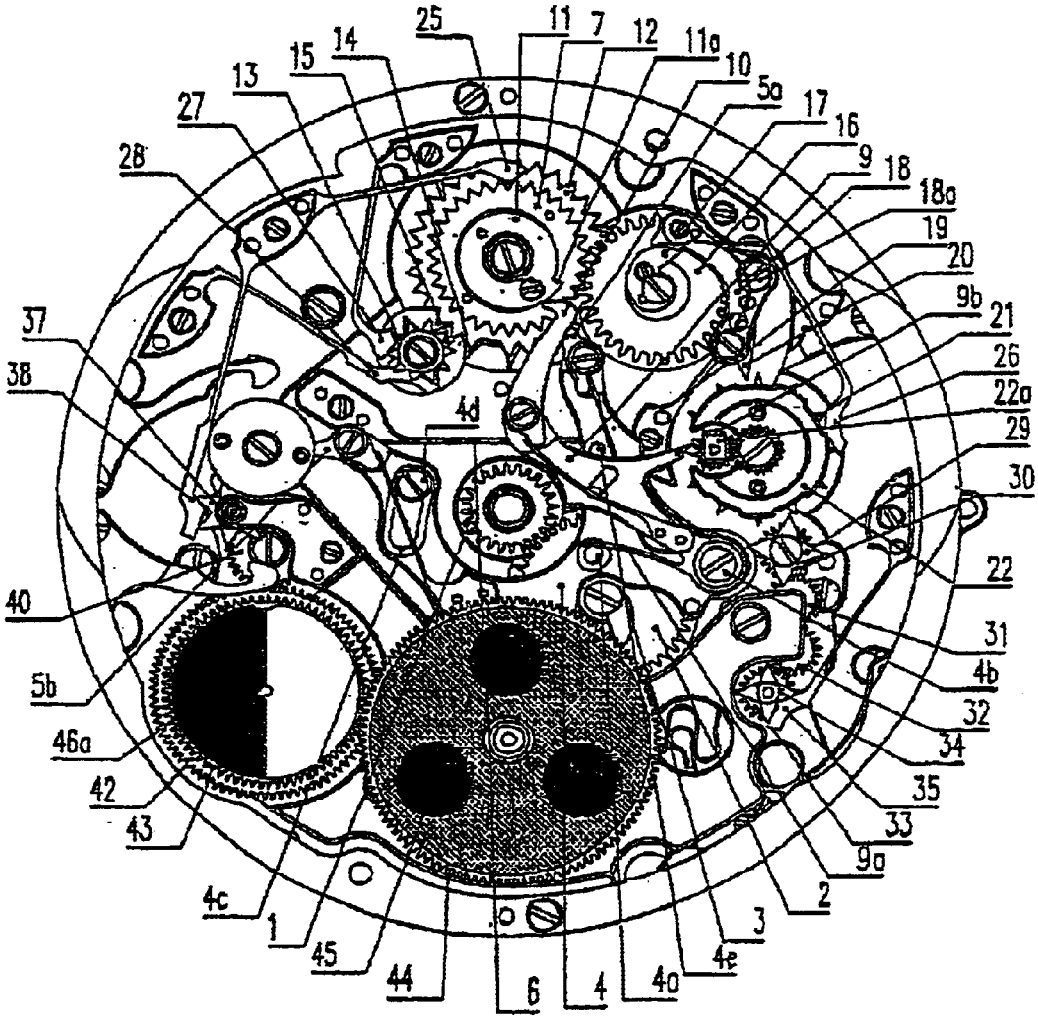
FIG. 2 is a plan view of the mechanism of FIG. 1 without the indicator disks, showing the position of the various components on February 28 of a year that is not a leap year at around midday.

This wheel 2 is secured to a cam 3 which operates with a pin 4*a* secured to a yoke 4 mounted to pivot about a spindle 4*b*. This yoke 4 is split into two arms each of which ends in a pawl 5*a*, 5*b* for the step-by-step drive of a 31-toothed day-of-the-month runner 7 and the step-by-step drive of a day-of-the-week star 8 (FIG. 1), respectively. This yoke 4 has an opening 4*c* in the shape of an arc of a circle centered on its pivot spindle 4*b*, in which opening a stop 4*d* is engaged. This yoke 4 is pressed against one end of this opening 4*c* by a return spring 6 engaged with a pin 4*e* of the yoke 4.

A second yoke 9, which constitutes a correction yoke, is mounted to pivot about the same spindle 4*b* as the yoke 4. It is connected to the latter by an elastic arm 9*a* which rests against the pin 4*a* of the yoke 4, which projects from both sides of this yoke 4. The yoke 9 ends in a pawl 10 intended to engage selectively with a notch 11*a* in a correction cam 11 secured to the day-of-the-month runner 7.

Figure 5:
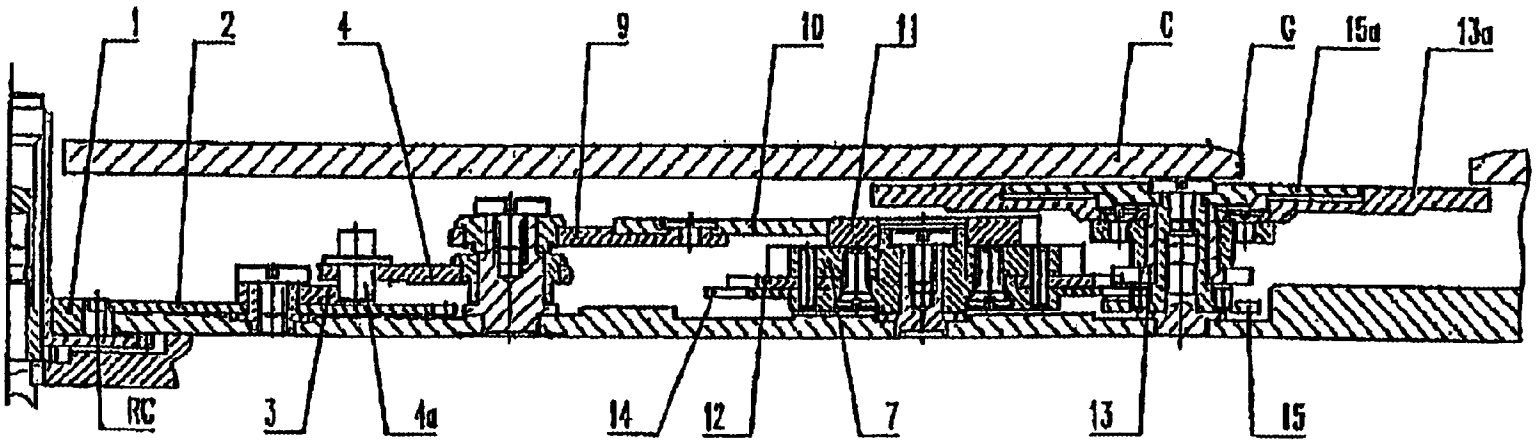
FIG. 5 is a view in section on the line V—V of FIG. 3.

The day-of-the-month runner 7 is also secured to two wheels, a unit drive wheel 12, comprising 30 teeth and an empty space corresponding to the $31^{st}$ tooth engaged with a 10-toothed star 13 for displaying the units of the day of the month. The second wheel secured to the day-of-the-month runner 7 is a 4-toothed tens-drive wheel 14 engaged with a star 15 for displaying the tens of the days of the month. Each of these stars 13, 15 is respectively secured to an annular disk 13*a* concentric with a disk 15*a* (FIGS. 1 and 5), the annular disk 13*a* bearing the numerals of the units from 0 to 9 and the disk 15*a* bearing the numerals of the tens from 0 to 3, it being possible for 0 to be replaced with an empty space. These numerals appear through an aperture G formed through the dial C of the timepiece (FIG. 5).

The day-of-the-month runner 7 engages, in a 1:1 ratio, with a wheel 16 secured to an instantaneous jump cam 17. A yoke 18 pivoting about a spindle 18*a* is pressed against the instantaneous jump cam 17 by a spring 19. This yoke 18 bears a drive pawl 20 which engages with a 12-toothed annual runner 21 secured to an annual cam 22 which has sectors of varying radii representative of the number of days in the months of the year. A portion 22*a* of this annual cam 22 is secured to a planet pinion 23 (FIG. 1) engaging with a months sun wheel 24 secured to the frame of the calendar mechanism. The gear ratio between the planet pinion 23 and the months sun wheel 24 is chosen so that this planet pinion 23 makes one revolution per four revolutions of the months sun wheel 24. The cam portion 22*a* has four sides, three of which are the same distance away from the axis of the pinion 23, while the fourth is a further distance away than the other three.

The second yoke 9 comprises a feeler arm 9*b* intended to come into contact with the periphery of the annular cam each time the yokes 4 and 9 move, that is to say once per day. Given that the various portions of the annual cam 22 have different radii according to the length of the month, the amplitudes of the movements of the yoke 9 and of its pawl 10 vary and the differences between the various amplitudes are absorbed by the elastic arm 9*a* of the yoke 9.

As illustrated by FIG. 1, the annual runner 21 is secured to a disk 21*a* bearing the indications of the 12 months of the year.

The day-of-the-month runner 7 and the annual runner 21 together with the units star 13 and the tens star 15 are positioned angularly by respective jumpers 25, 26, 27, 28.

One of the teeth of the annual runner 21 is markedly thicker than the other 11 teeth. Thanks to this thicker tooth, the annual runner 21 drives a four-branched star 29 by one step per year. This star is secured to an intermediate wheel 30 which drives a set of intermediate wheels, 31, 32, 33 the last of which is secured to a four-branched star 34 engaged with a jumper 35. This star 34 is also secured to a disk 34*a* (FIG. 1) bearing the numerals 1, 2, 3 and the letter B to indicate a 4-year cycle in which one year is a bissextile year (leap year) B.

The day-of-the-week star 8 (FIG. 1) is positioned by a jumper 41 and bears a disk 36 on which the days of the week are displayed. This 7-branched star 8 is engaged with a second star 37, also having 7 branches, positioned by a jumper 38. This second star 37 is secured to a pinion 39 (FIG. 1) which engages with an intermediate wheel 40 which engages with a wheel 42 secured to and coaxial with a wheel 43 which engages with a wheel 44 to indicate the phases of the moon. The gear ratios of this gear set between the day-of-the-week star 8 and the wheel 44 for indicating the phases of the moon are chosen so that the wheel 44 makes one revolution in three lunar months, so that this wheel 44 bears three circles 45 representing the moon, distributed 120° apart on the wheel 44 so that each of them can be used to indicate a lunar cycle in conjunction with an aperture (not depicted) of appropriate shape, formed through the dial C, to simulate the phases of waxing and waning of the moon visible in the aperture.

A third wheel 46 pivots on the same spindle as the wheels 42, 43 of the moon-phase gear set. This third wheel 46 (FIG. 1) bears a disk 46*a* split into two sectors of 180° each, one being black and the other white to indicate night-time hours and daytime hours through an aperture (not depicted) made in the dial C of the timepiece. As can be seen in FIG. 1, the wheel 46 engages with an intermediate wheel 47 which engages with a wheel 48, coaxial with the moon-phase wheel 44 which engages with the wheel 2 of the calendar. These wheels 46, 48 and 2 have 1:1 ratios with respect to one another which means that the wheel 46 makes one revolution in 24 hours as does the wheel 2. Thus, for 12 hours the black shows through the aperture in the dial and the white shows through this aperture for the next 12 hours.

The way in which the calendar mechanism described hereinabove works is as follows:

Every 24 hours, the cam 3 secured to the wheel 2 of the calendar gradually lifts the yokes 4 and 9 against the pressure exerted by the return spring 6 on the yoke 4. As they pivot, the pawls 5*a*, 5*b* are displaced in the clockwise direction about the pivot spindle 4*b* of the yokes 4, 9, thus disengaging from the teeth 7 and 8 and the finger 9*b* of the yoke 9 to a greater or lesser extent limits the amplitude of pivoting of this yoke 9 according to which part of the annual cam 22 lies in the path of this finger 9*b* and against which this finger 9*b* abuts. During the rest of its pivoting, the yoke 4 pivots with respect to the correction yoke 9, this relative pivoting of this yoke 4 with respect to the yoke 9 being absorbed by deformation of the elastic arm 9*a* of this yoke 9.

During the period ranging from the $1^{st}$ to the $29^{th}$ of the month, the yoke 9 and its pawl 10 have no function, the pawl 10 sliding against the plain surface of the correction cam 11 with each back and forth movement of the yokes 9 and 10. In the case of a 30-day month, when the day of the month changes between the $30^{th}$ and the $1^{st}$ of the next month, when the finger 9*b* of the yoke 9 rests against one of the smaller-diameter portions of the annual cam 22, the pawl 10 engages behind the notch 11*a* in the correction cam 11 so that when the cam 3 frees the yokes 4 and 9 to the return force of the spring 6, the pawl 10 drives the correction cam 11, by the magnitude of two steps of the day-of-the-month wheel 7, secured to this correction cam 11, causing the day of the month to move from 30 to 01.

When there is a change in day of the month during a month, either there is only a change in units and the wheel 12 drives the star 13 by one step or there is a simultaneous change of units and of tens and the wheels 12 and 14 drive the stars 13 and 15 respectively by one step simultaneously.

At the end of a 31-day month, as the units of the next day of the month, 01, do not change, only the tens changes. This is why the day-of-the-month wheel 12 has 30 teeth and a space corresponding to a missing tooth. Thus, during the switch from the $31^{st}$ to the $01^{st}$, the missing tooth of the day-of-the-month wheel finds itself facing the units star 13 so that the latter is not driven and so that the numeral 1 is displayed on two consecutive days. Only the tens star 15 is driven by one step by the four-toothed tens wheel 14, causing the tens disk 15*a* to move on from 3 to 0.

Figure 3:
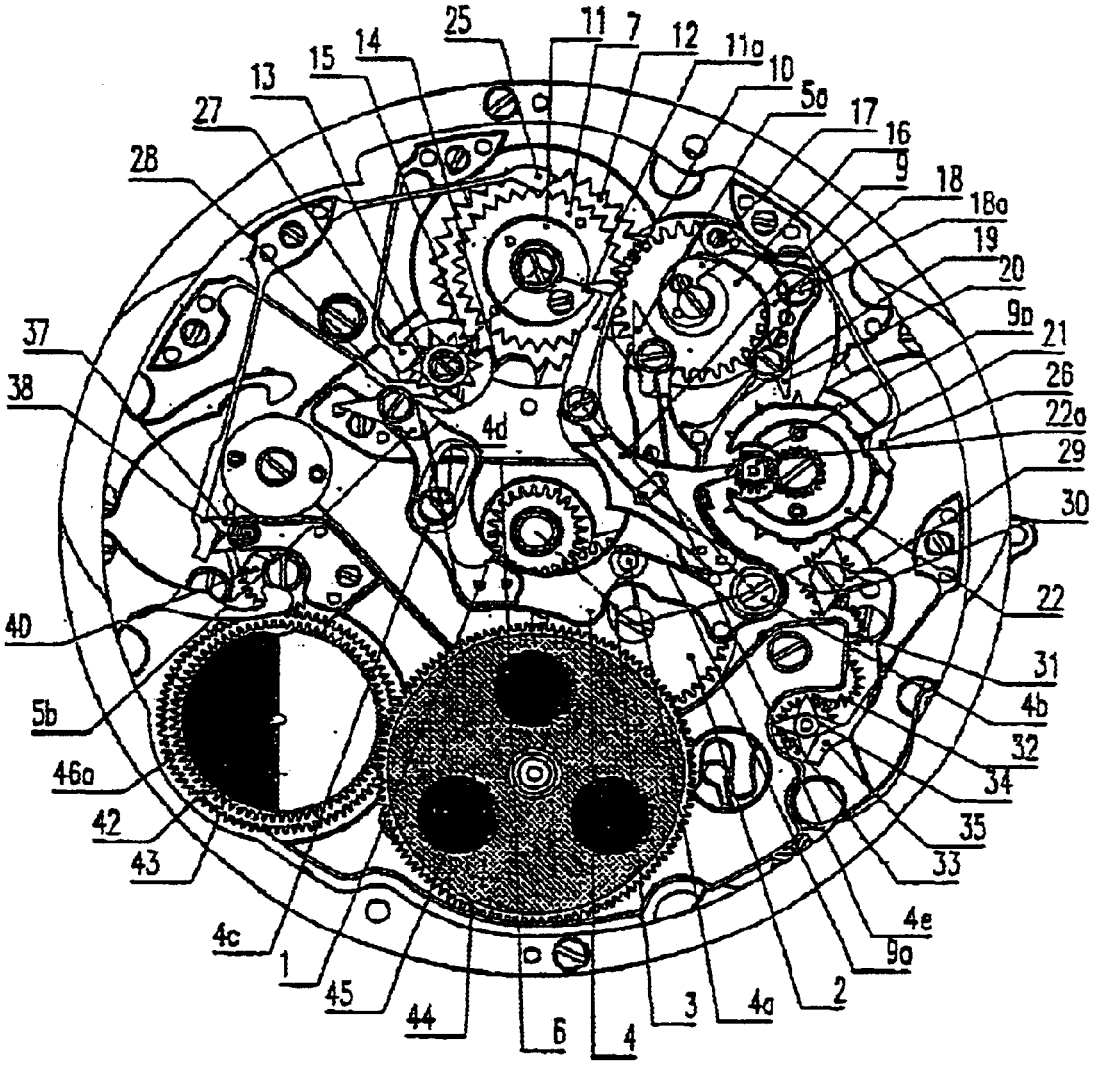
FIG. 3 is a view similar to FIG. 2, showing the position of the various components just before midnight, and therefore just before the date change.
Figure 4:
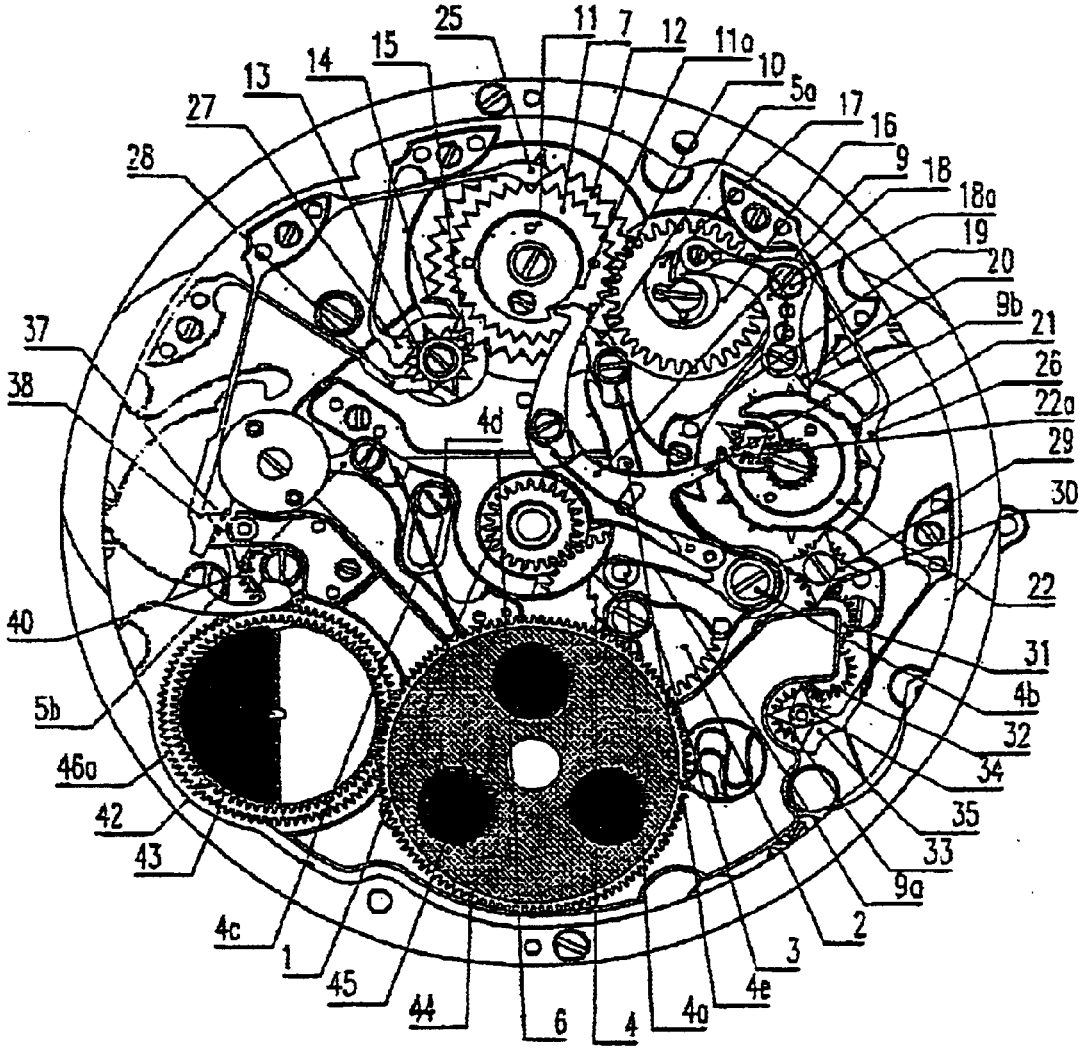
FIG. 4 is view similar to the previous figure, showing the position of the various components on March 1 after the date change.

For the calendar to be perpetual, the annual cam 22 has a portion 22*a* secured to a planet pinion 23 (FIG. 1) which corresponds to the correction to be made at the end of the month of February which has either 28 days in a normal year or 29 days in a leap year. This cam portion 22*a* makes one quarter of a revolution each year and has four sides, one of which is a greater distance away from the center of the planet pinion 23 than the other three. When the finger 9*b* of the correction yoke 9 faces this cam portion 22*a* during a 28-day month of February, it allows the correction yoke 9 to rock through a greater angle than it does in the other months, so that on February 28, the pawl 10 of the yoke 9 comes behind the notch of the correction cam 11, as illustrated in FIG. 3; this then is the maximum amplitude of the correction yoke 9. As soon as the instantaneous jump cam 3 releases the drive yoke 4 to the pressure of the spring 6, the pawl 10 of the correction yoke 9 drives the day-of-the-month wheel by four steps, causing the display on the disks 13*a* and 15*a* to move on instantaneously from 28 to 01.

In a leap year, it is the surface of the portion 22*a* of the cam 22 which is furthest from the center of the planet pinion 23 which faces the finger 9*b* of the correction yoke 9, the distance from this surface to the center of pivoting of the cam 22 being between the distance of the cam surfaces 22 relating to the 30-day months and the distance of the surfaces of the cam portion 22*a* corresponding to 28-day months of February, which means that the pawl 10 will engage with the notch 11*a* of the correction cam 11 on February 29 and will advance the day-of-the-month wheel 7 simultaneously and instantaneously by three steps. These corrections to the day-of-the-month runner cause a synchronous change in the annual runner 21 and in the months display disk 21*a* secured to this annual runner 21.

By contrast, these corrections have no influence on the pawl 5*b* that drives the star 8 secured to the day-of-the-week disk which days of the week obviously follow on from one another in an immutable manner, this star 8 causing the wheel 44 to advance each day to indicate the phases of the moon by a fraction of a lunar cycle corresponding to a solar day.

The continuous movement of the wheel 2 engaged with the drive wheel 1 secured to the hour wheel RC is imparted to the wheel 46 bearing the black/white sectors that indicate daytime hours and night-time hours with a ratio 1:1.

What is claimed is:

1. A timepiece with a large-format calendar display and instantaneous jump comprising a time train, a day-of-the-month runner comprising a 31-toothed wheel, a unit wheel of 30 teeth plus one space corresponding to a tooth for driving a 10-toothed unit star and a four-toothed wheel for driving a four-toothed tens star, an annual cam secured to a 12-toothed wheel, and drive means connected to said time train for driving said day-of-the-month runner by one revolution per month and the annual cam by one revolution per year, wherein said day-of-the-month runner is secured to a correction member, said drive means comprising an instantaneous jump cam secured to a wheel connected to said time train to make one revolution per day, a driving yoke equipped with a retractable driving finger, elastic means pressing this driving yoke against the instantaneous jump cam, a correction yoke comprising a retractable drive finger engaged with said correction member, a feeler designed to detect the position of said annual cam and elastic means for connecting said yokes together, so as selectively to engage said retractable driving finger of the correction yoke with said correction member according to the position of said annual cam as detected by said feeler.

2. The timepiece with a perpetual calendar as claimed in claim 1, in which said annual cam is secured to a planet pinion engaged with a months sun wheel secured to a frame of the calendar mechanism, this planet pinion being designed to make one quarter of a revolution per revolution of said annual cam and bearing four cam segments three of which correspond to the correction to be made at the end of the month of February which has 28 days, while the fourth corresponds to the correction to be made at the end of the month of February in a leap year.

3. The timepiece as claimed in claim 1, in which said drive yoke comprises a second retractable finger to engage with a seven-toothed runner for indicating the days of the week.

4. The timepiece as claimed in claim 3, in which said seven-toothed runner for indicating the days of the week is in connection with a train for indicating phases of the moon.

5. The timepiece as claimed in claim 4, in which an axis of the indicator runner of the train for indicating the phases of the moon is coaxial with one indicator runner of an additional time train engaged with said first time train to allow indication of the time in a second time zone.

6. The timepiece as claimed in claim 3, in which an axis of the runner bearing an indicator of the days of the week and an axis of said 12-toothed wheel bearing a month indicator occupy positions that are symmetric with respect to the 12 o'clock–6 o'clock diameter of a dial of the timepiece and are situated near the 9 o'clock–3 o'clock diameter of this dial, a radii of these two day and month indicators respectively leaving a space between them, an axis of said units and tens stars being situated near the periphery of a indicator runner of the days of the week situated to the left of the 12 o'clock–6 o'clock diameter and a radius of said units indicator disk being adjacent to the radius of the indicator runner situated to the right of this same diameter.

7. The timepiece as claimed in claim 1, in which said drive means for driving said annual cam comprise a third yoke associated with a spring to engage this yoke with a second instantaneous jump cam secured to an intermediate wheel engaged with said 31-toothed wheel, this third yoke comprising a finger engaged with said 12-toothed wheel secured to said annual cam.

8. The timepiece as claimed in claim 1, in which said units and tens stars are coaxial, tens star being secured to a disk bearing the numerals from 0 to 3 while the units star is secured to an annular disk surrounding the tens disk and bearing the numerals from 0 to 9.

9. The timepiece as claimed claim 8, in which an axis of the seven toothed runner bearing a indicator of the days of the week and the axis of said 12-toothed wheel bearing a month indicator occupy positions that are symmetric with respect to the 12 o'clock–6 o'clock diameter of the dial of the timepiece and are situated near the 9 o'clock–3 o'clock diameter of this dial, the radii of these two day and month indicators respectively leaving a space between them, an axis of said units and tens stars being situated near a periphery of the indicator of the days of the week situated to the left of the 12 o'clock–6 o'clock diameter and the radius of said units indicator being adjacent to the radius of the month indicator situated to the right of this same diameter.

10. The timepiece as claimed in claim 9, in which the indications borne by four indicator disks indicating the days, the tens, the units and the months respectively, are aligned.

* * * * *